United States Patent [19]

Rector

[11] 4,384,372

[45] May 24, 1983

[54] BACK SUPPORT BELT ATTACHMENT

[76] Inventor: Michael H. Rector, 195 Park, Pismo Beach, Calif. 93449

[21] Appl. No.: 170,952

[22] Filed: Jul. 21, 1980

[51] Int. Cl.[3] ..... A41F 9/00

[52] U.S. Cl. ..... 2/300; 2/338; 128/78

[58] Field of Search ..... 2/300, 44, 45, 2, 338, 2/339; 128/78, 99, 100, 102

[56] References Cited

U.S. PATENT DOCUMENTS

| | | | |
|---|---|---|---|
| 656,918 | 8/1900 | Wighard | 2/339 |
| 1,174,757 | 3/1916 | Packer | 128/78 |
| 2,250,267 | 7/1941 | Lins | 2/44 X |
| 2,642,578 | 6/1953 | Marchese | 2/300 |
| 2,973,030 | 2/1961 | Matthewson | 2/300 X |
| 3,154,072 | 10/1964 | Mack | 128/78 |
| 4,175,548 | 11/1979 | Henry | 128/78 X |

FOREIGN PATENT DOCUMENTS

| | | | |
|---|---|---|---|
| 86787 | 10/1920 | Switzerland | 2/300 |

*Primary Examiner*—H. Hampton Hunter
*Attorney, Agent, or Firm*—Melvin R. Stidham

[57] ABSTRACT

A relatively wide back support for a police officer or the like, including an outer support panel of relatively stiff leather, which is sewn to a resilient foam material encased in fabric. A pair of leather patches on the inner surface cover the "dimples" in the wearer's back and slots therein form a belt loop so that the brace can be attached directly to the trouser-supporting belt of the wearer. A number of pairs of horizontal slots extend across the outer panel to receive other loops. The loops will accommodate the conventional Sam Brown belt worn by police officers, or they will allow other equipment such as batons, handcuffs and the like is the case of police officers and tools in the case of tradesmen, to be suspended from the wide back brace.

3 Claims, 4 Drawing Figures

BACK SUPPORT BELT ATTACHMENT

BACKGROUND OF THE INVENTION

Many tradesmen carry tools and equipment suspended from a belt around their waists, for example, a police officer commonly carries his gun, baton, hand cuffs, flash light and other equipment suspended from a Sam Brown belt worn around the waist so that all the weight and the equipment is concentrated from a single belt. In the past, the weight of the equipment so suspended from the belt, was at least partially supported by the wearer's shoulder by reason of a diagonal belt which was originally secured at opposite ends to the Sam Brown belt and extended over a shoulder. However, the diagonal belt presented an attractive "handle" for a would-be attacker and some unfortunate experiences that have occured in the past resulted in the decision to remove the diagonal belt as a part of the patrolman's uniform. Consequently, virtually all of the equipment weight is borne by the lower back.

The officer, with all this weight may get in and out of a patrol car numerous times during the course of a day's activities, and this repeated impact with the patrol car seat, while wearing all this equipment can cause damage to the seat, as well as to his back. The resultant damage to the seat aggravates the back problem because of the diminished support provided thereby.

OBJECTS OF THE INVENTION

It is an object of this invention to provide a back support which will distribute the load of suspended tools and equipment over a wider area.

It is a further object of this invention to provide a back support which will apply a certain amount of pressure to the lower back to decrease incidence of lower back injury.

It is a further object of this invention to provide a back brace which may be unified with the wearer's trouser-supporting belt as well as to the equipment-supporting belt.

Other objects and advantages of this invention will become apparent from the description to follow, particularly when read in conjunction with the accompanying drawing.

SUMMARY OF THE INVENTION

In carrying out this invention, I provide a relatively wide back brace having an outer panel of a relatively stiff leather and long enough to extend over the kidney areas. An inner panel of a resilient foam material covered with fabric is stitched to the leather back panel, and is of a larger area then the back panel so that there is a margin of resilient material extending completely around the back brace. A plurality of horizontal slots in the back panel enable loops of leather or the like to be extended therethrough to suspend equipment from the large area back panel, as well as to receive the Sam Brown belt conventionally worn by police officers. A pair of leather support patches on the inside of the back brace have vertical slots to receive the officer's trouser-supporting belt so that the back brace is unified with both the trouser supporting and the equipment-supporting belts, all around the waistline of the wearer. The outer panel is relatively wide and the lower edge extends downward at the mid-point to cover, protect and brace the lower spine of the wearer.

DESCRIPTION OF A PREFERRED EMBODIMENT

Figure 1:
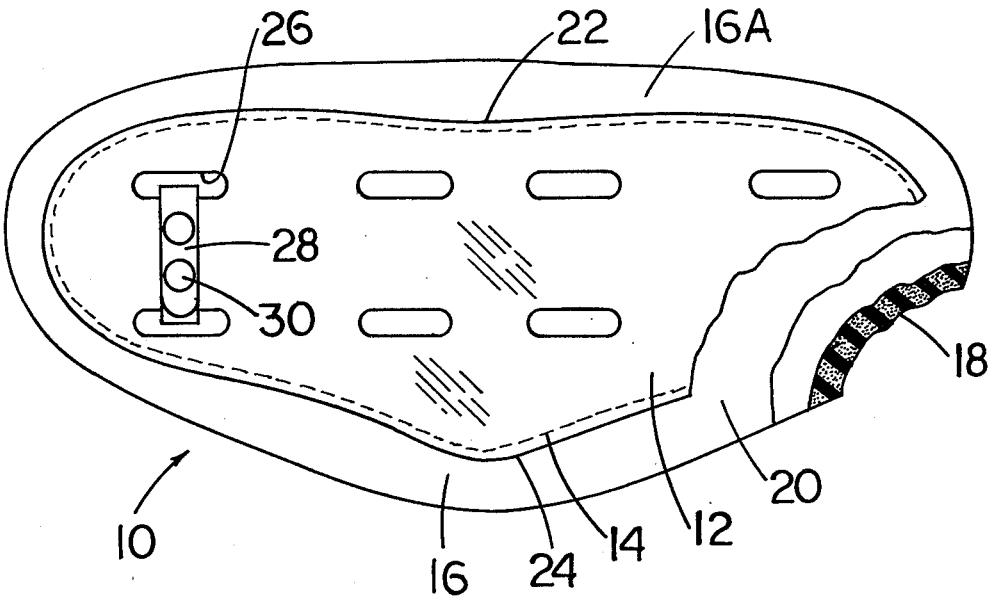
FIG. 1 is a back view of the back brace of this invention.
Figure 2:
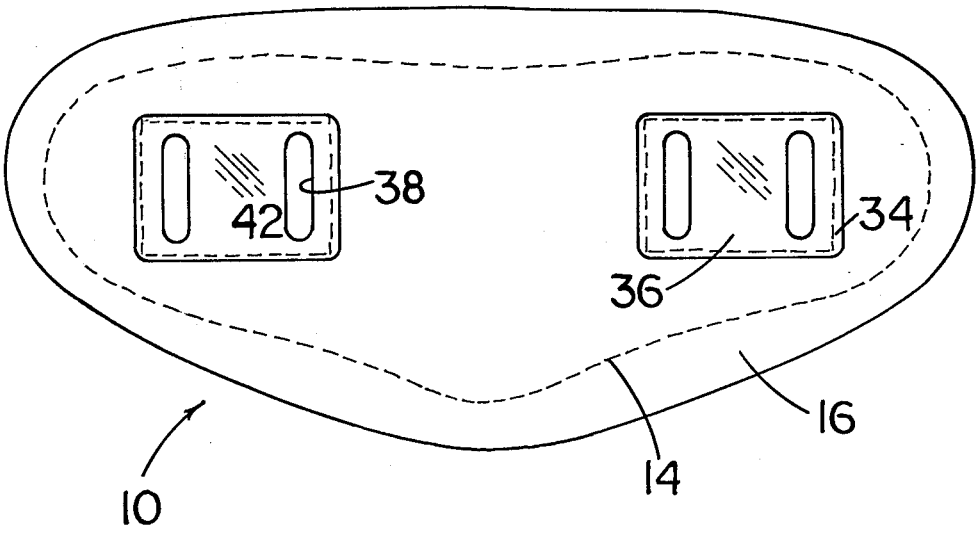
FIG. 2 is a front view of the back brace.

Referring now to FIGS. 1 and 2 with greater particularity, the back brace belt attachment 10 of this invention includes a back panel 12 of a relatively stiff leather, or a synthetic material having similar characteristics of rigidity. The back panel 10 is stitched at 14 to a padded inner pad of resilient material.

For example, the inner ply could comprise a closed cell foam plastic 18 encased in a cover of a suitable fabric such as a strong Nylon.

As shown best in FIG. 1, the brace is relatively wide from top to bottom, and the stiff back panel 12 has a relatively horizontal top edge 22 extensive enough to cover the kidney area of the wearer. However, the bottom panel curves downward at 24 to extend down over the lower spine of the wearer. The inner panel 16 is of larger area than the back panel 12 to provide a resilient margin **16*a* completely around the back panel 12** which prevents the back panel from digging into the flesh of the wearer while bending, stooping or sitting.

Figures 3, 4:
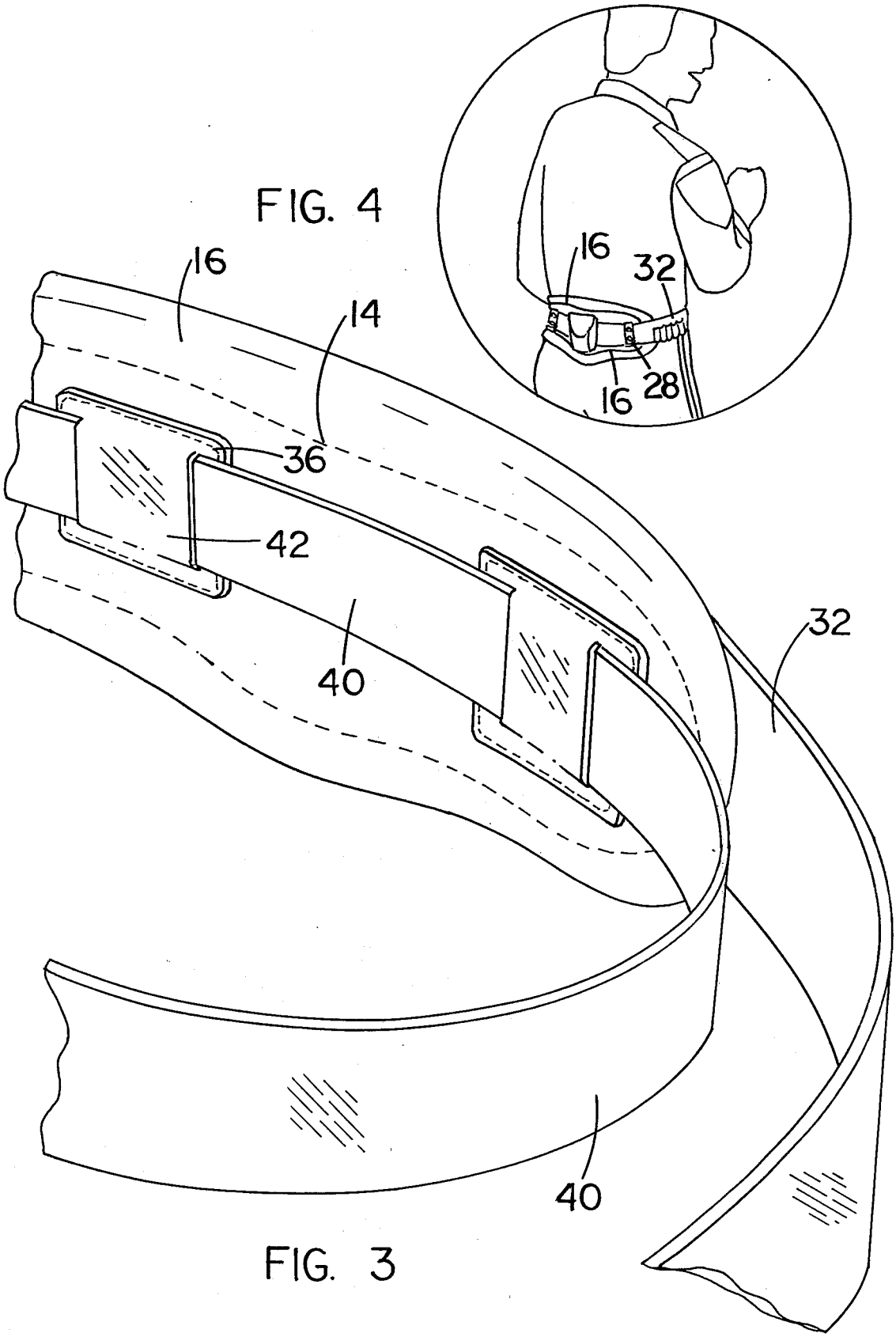
FIG. 3 is a view in perspective showing the trouser-supporting belt and the equipment-supporting belt both attached to the back brace.
FIG. 4 is a view in perspective showing the belt and back brace in place.

A series of pairs of horizontal slots 26 in the back panel 12 are adapted to receive loops 28 of leather or the like, the ends of which are snapped together at 30. The loops are conditioned to receive the officer's baton, flashlight holder or the like and, in addition, will receive the officer's Sam Brown belt 32 (FIGS. 3 and 4) on which bullets, gun and other equipment are frequently carried. Hence, as well as a back brace, the belt attachment 10 provides a means for distributing the weight of equipment being carried by it, or by the Sam Brown belt, over a wider area which, in addition, is cushioned.

Stitched at 34 to the inside of the resilient pad, prior to attachment of the back panel 12 is a pair of leather stiffener patches which are positioned to engage and press against the "dimples" of the wearer's back, on either side of the spine and to provide support therefor. A pair of vertical slots 38 in each stiffener patch enables the police officer to thread his trouser-supporting belt 40 through the loops 42 formed between the slots to maintain proper location of the back brace 10 on his back. Thus, when the patrolman dons his uniform, he can extend his belt through the side loops of this trousers and then, simultaneously through the loops 42 on the leather patches and the back loops on his trousers. With the back brace in place, the Sam Brown belt may be then extended through loops 28 placed in the horizontal pairs of slots 26 to distribute the load on the Sam Brown belt and to keep it from sliding down over the hips.

While this invention has been described in conjunction with a preferred embodiment thereof, it is obvious that modifications and changes therein may be made by those skilled in the art to which it relates, without departing from the spirit and scope of this invention as defined by the claims appended hereto.

What is claimed as invention is:

1. For use with a waistline belt from which equipment is to be suspended, a back brace comprising:

an outer panel of a material having the rigidity of a relatively stiff leather;

said outer panel being relatively wide and extending laterally to cover the kidney area of the wearer;

the top edge of said outer panel being relatively horizontal, and the lower edge thereof curving downward from both sides toward the mid-portion thereof to cover the lower spine of the wearer;

an inner pad of a resilient material secured to said outer panel;

said inner pad being of a larger area than outer panel to provide a margin of resilient material around said outer panel;

loops adapted to support tools therefrom; and means for securing said loops to said outer panel;

said loops being large enough to accommodate a waistline belt; and a pair of stiffener patches secured to the inner surface of said inner pad and adapted to cover the indentations in the wearer's back on either side of his spine.

2. The back brace defined by claim 1 including:

a pair of slots in each of said stiffener patches;

said slots forming between them belt loops to receive the trouser-supporting belt of the wearer.

3. The back brace defined by claim 1 wherein:

said inner pad is of a foam material, and including:

a fabric encasing said inner pad.

* * * * *